US010646003B2

(12) United States Patent
Zanaty, Sr.

(10) Patent No.: US 10,646,003 B2
(45) Date of Patent: May 12, 2020

(54) SNAP NO MO

(71) Applicant: Charles Norman Zanaty, Sr., Birmingham, AL (US)

(72) Inventor: Charles Norman Zanaty, Sr., Birmingham, AL (US)

( * ) Notice: Subject to any disclaimer, the term of this patent is extended or adjusted under 35 U.S.C. 154(b) by 151 days.

(21) Appl. No.: 15/703,272

(22) Filed: Sep. 13, 2017

(65) Prior Publication Data

US 2019/0075893 A1 Mar. 14, 2019

(51) Int. Cl.

| | |
|---|---|
| ***A44B 17/00*** | (2006.01) |
| ***A44B 11/00*** | (2006.01) |
| ***A44B 11/04*** | (2006.01) |

(52) U.S. Cl.

CPC ..... *A44B 17/00* (2013.01); *A44B 11/005* (2013.01); *A44B 11/04* (2013.01); *A44D 2205/00* (2013.01)

(58) Field of Classification Search

None

See application file for complete search history.

(56) References Cited

U.S. PATENT DOCUMENTS

| | | | | |
|---|---|---|---|---|
| 4,672,910 | A * | 6/1987 | Cook | B63B 17/02 114/343 |
| 5,396,861 | A * | 3/1995 | Acker | B63B 17/02 114/361 |
| 5,483,915 | A * | 1/1996 | Clark | B63B 17/02 114/361 |
| 5,732,645 | A * | 3/1998 | Lemke | B63B 59/02 114/219 |
| 2006/0225255 | A1* | 10/2006 | Kawensky | B63B 17/02 24/324 |
| 2012/0192384 | A1* | 8/2012 | Kelly | F16B 2/08 24/302 |
| 2017/0029076 | A1* | 2/2017 | Maietti | B63B 17/02 |
| 2017/0127769 | A1* | 5/2017 | Hunter | B60J 7/104 |

* cited by examiner

*Primary Examiner* — Sarah B McPartlin

(57) ABSTRACT

The Snap No Mo invention centers around the innovative concept of providing a fast, easy and safe way to connect, install or remove any item. This concept uses or replaces the conventional snap fasteners system for connecting any item with less effort to the installer or damage to the material and with a minimal amount of strength.

3 Claims, 14 Drawing Sheets

Famale Snap Fastener to Male Snap Fastener on item to be Covered

SNAP NO MO

FIELD OF THE INVENTION

This invention relates to a method and system for installing covers that currently use the Snap Fasteners System. Particularly, this invention relates to the installation of a protective cover with female snaps, (as an example but not limited to boat covers, truck covers, etc.) and any item using the male snap (as an example but not limited to boats, trucks, etc) More particularly, the invention relates to an easier method and system for installing a protective cover that currently uses the snap fasteners to secure the cover to an item or structure. Specifically, the invention once installed relates to a novel technique for securing protective covers without the need of snapping and unsnapping the installed snap fasteners.

This invention is for all items requiring the use of a male and female snap to attach one item to another or extend the distant if required for the male and female snap to attach one item to another.

This invention can also be used to add additional length to any type snap fastening system that may no longer line up with the original manufactured specifications.

This invention as described above less snaps is also further applicable to new protective covers being manufactured and items to be covered, thus eliminating the need for the Snap Fasteners System to be installed in the first place.

BACKGROUND OF THE INVENTION

Conventional methods use the snap fasteners system for installing covers. This is often more difficult when for an example a boat is docked and subjected to wind forces, currents and waves, particular if the cover is form fitting or has shrunk with age. Most covers are secured from the outside of the item to be covered and as an example on boat covers requires reaching from the dock or pier to connect the snaps. Pushing the snaps together will often push the boat away from the installer. Though other items to be covered may not be subjected to the forces of nature the cover installation still involves aligning both snaps which often can not be seen due to the way the snaps are installed on the cover and a great deal of strength.

Uninstalling and removing a cover also requires a great deal of strength with the typical method of grabbing the cover on either side of the snap and pulling or yanking the snap off. This can be dangerous while reaching across to grasp the cover and also strenuous on back muscles, arms, fingers and often results in broken finger nails.

It is apparent that a need exists for a technique whereby a cover can be easily installed or removed from an item or structure that it is intended to protect, such as boat covers, chair covers, table covers, and other items that require protection. It is the objective of the present invention to provide an easy method and system for the proper and safe installation and removal of protective covers currently using (but not limited to) the snap fasteners system.

A further objective of the present invention is to provide a technique that lessens the time required to install or remove a protective cover. More time will be available for relaxation and the enjoyment of the item due to faster removal and installation of the cover.

SUMMARY OF THE INVENTION

The method and the system of this invention centers around the innovative concept of providing an easy and safe way to install or remove protective covers with a minimal amount of effort and time that currently uses the snap fasteners system.

The retro system provides a secure attachment using a hook and loop strap that utilizes the cover's female snap and the male snap on the item to be covered. The retro system consist of two parts, one that attaches to the covers' female snap with a male snap and a second part that attaches to the male part on the item to be covered with a female snap. The strap that stays attached to the cover has both the hook and loop with a male snap attached to the end. The second part consists of a buckle with a female snap that attaches to the items that are to be covered. Both parts stay attached to the cover and the item to be covered. The hook and loop that attaches to the cover and the part that consists of a buckle with a female snap will be offered in a number of different sizes with custom lengths and widths available for special order. Typical male and female snaps sizes are listed below, but all sizes not limited to sizes below will be available for special order.

| Diameter, inches | Diameter, millimeters |
|---|---|
| 0.30 | 7.6 |
| 0.35 | 8.9 |
| 0.38 | 9.5 |
| 0.40 | 10.2 |
| 0.45 | 11.4 |
| 0.48 | 12.1 |
| 0.50 | 12.7 |
| 0.60 | 15.4 |

The system for new installation provides a secure attachment using a hook and loop strap that will be attached to the covers during manufacturing with no need for the manufacture to install female snaps. The buckle part will be installed during manufacturing with no need for the manufacture to install the male snap on the item to be covered.

It is apparent that a need exists for a technique whereby a protective cover can be installed and removed safely and easily without bodily or material damage. The present invention is directed toward providing such a technique.

It is an objective of the present invention to provide a method and a system for installation and removal of protective covers safely and easily without bodily or material damage. It is also an objective of the present invention to provide a method and a system for installation and removal of a protective cover with efficiency and effectiveness. A further objective of the present invention is to provide a technique that increases the time-available for use of the items covered. These and other objectives of the invention will be apparent to those skilled in the art from the description that follows.

BRIEF DESCRIPTION OF THE DRAWINGS

A clear understanding of the key features of the invention summarized above may be had by reference to the appended drawings which illustrate the method and system of the invention, although it will be understood that such drawings depict preferred embodiments of the invention and, therefore, are not to be considered as limiting its scope with regard to other embodiments which the invention is capable of contemplating. Accordingly:

FIG. 1 is an illustration of the method and system of this invention showing the hook and loop strap with a marine grade stainless male snap referenced as part A.

FIG. 2 is an illustration of the method and system of this invention showing the buckle section with a marine grade stainless female snap referenced as part B FIG. 3 is an illustration of the method and system of this invention showing the hook and loop strap with a marine grade stainless male snap that is referenced as part A and the buckle section with a marine grade stainless female snap that is referenced as part B.

FIG. 4 is an illustration of the method and system of this invention showing the hook and loop strap with a marine grade stainless male snap referenced as part A looped through the buckle section referenced as part B FIG. 5 is an illustration of the method and system of this invention showing the hook and loop strap with a marine grade stainless male snap that is referenced as part A attached to the cover female snap.

FIG. 6 is an illustration of the method and system of this invention showing buckle section with a marine grade stainless female snap that is referenced as part B attached to the male snap on the item to be covered.

FIG. 7 is an illustration of the method and system of this invention showing the hook and loop strap with a marine grade stainless male snap that is referenced as part A that is attached to the cover female snap and looped through the buckle section with a marine grade stainless female snap that is referenced as part B attached to the male snap on the item to be covered.

DETAILED DESCRIPTION OF THE INVENTION

Figure 1:
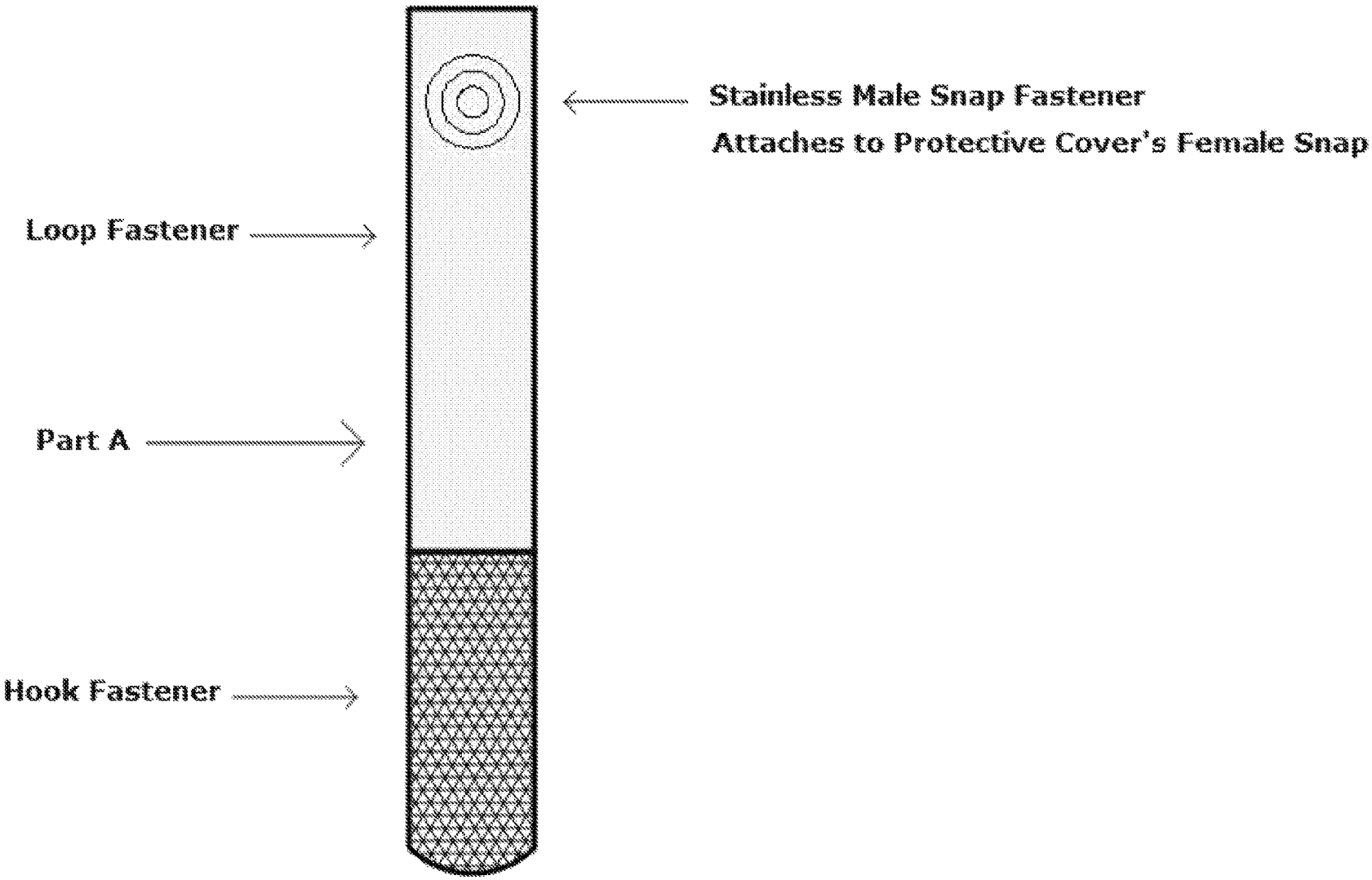
FIGS. 1 through 7 represents the retro system.

Referring to FIG. 1 is showing item A which is the hook and loop strap with a marine grade stainless male snap ready to be attached to a protective cover using the covers female snap.

Figure 2:
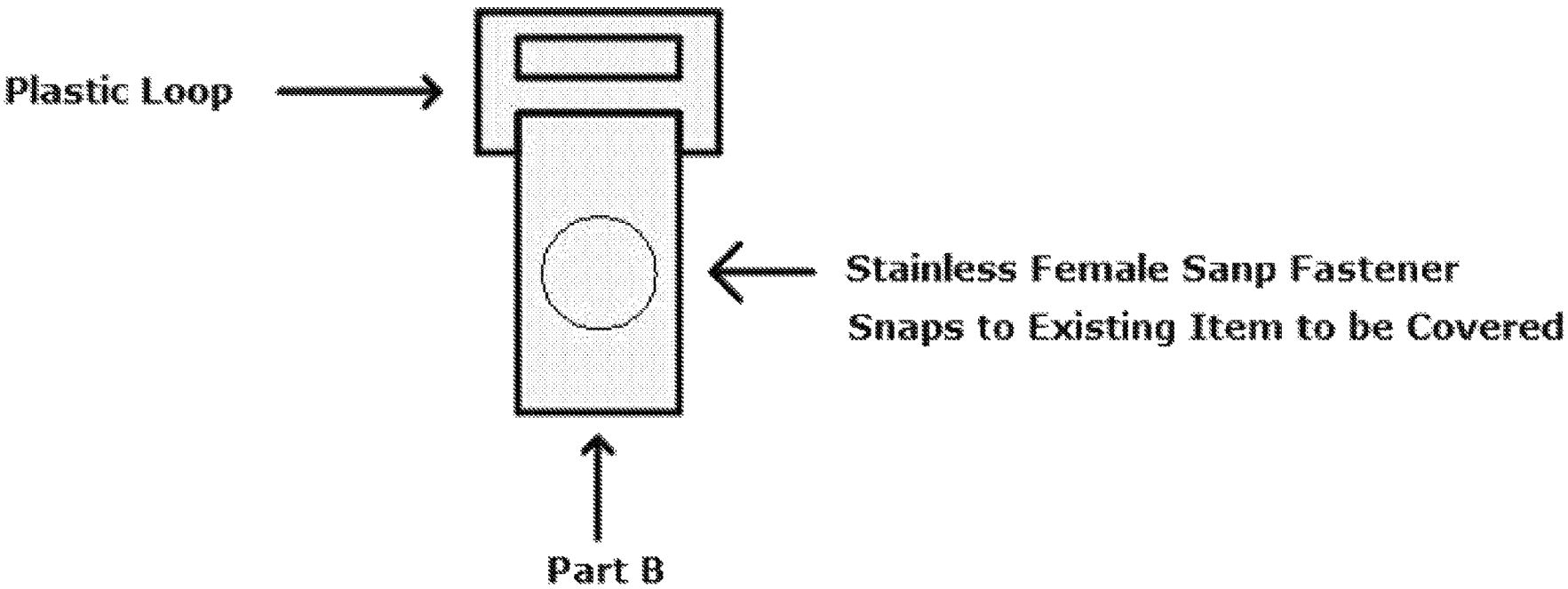

Referring to FIG. 2 is showing item B which is the buckle section with a marine grade stainless female snap ready to be attached to the item to be covered using the items male snap.

Figure 3:
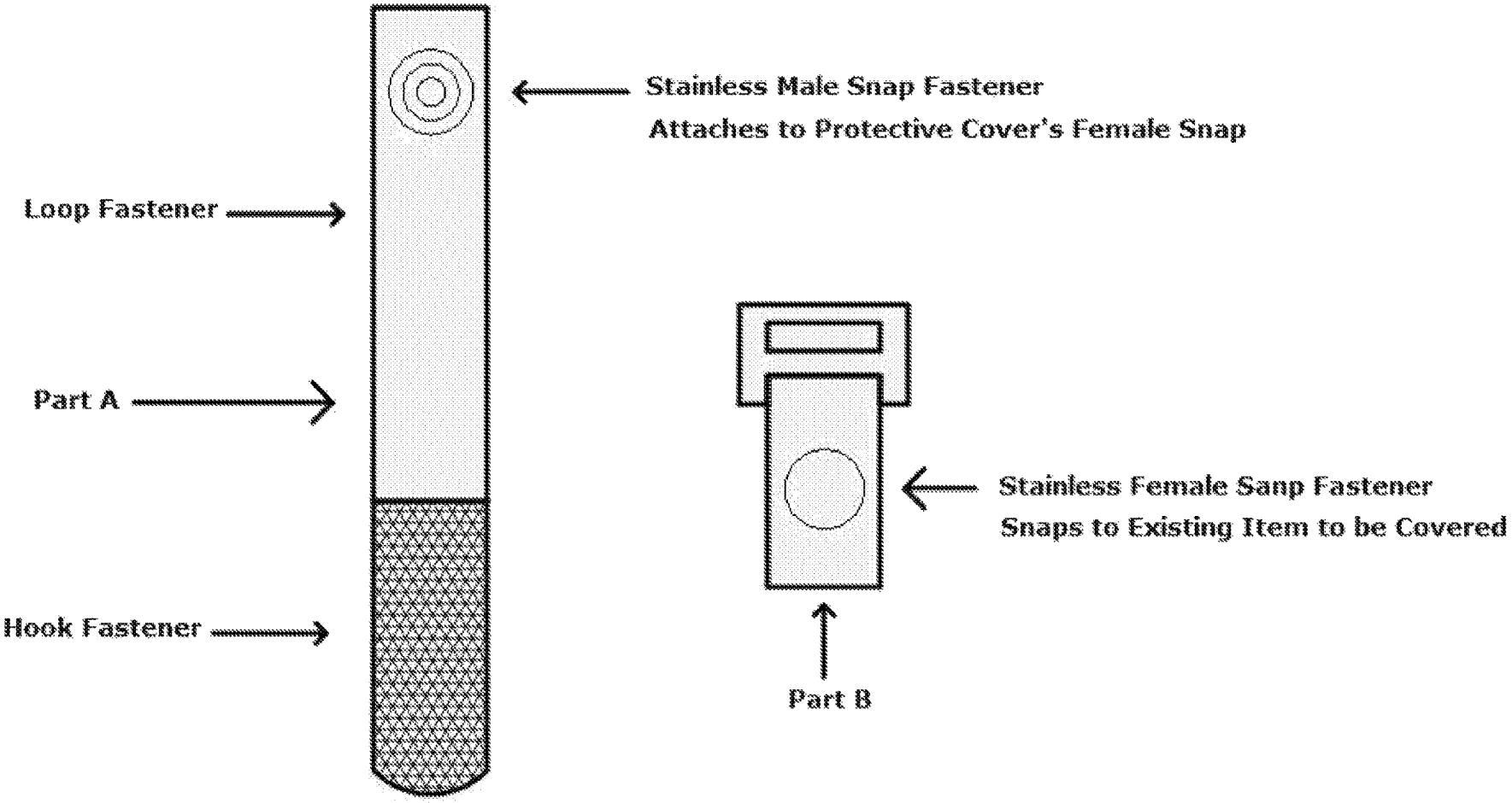

Referring to FIG. 3 is showing both items A and B which are ready to be attached to the protective cover and item to be covered.

Figure 4:
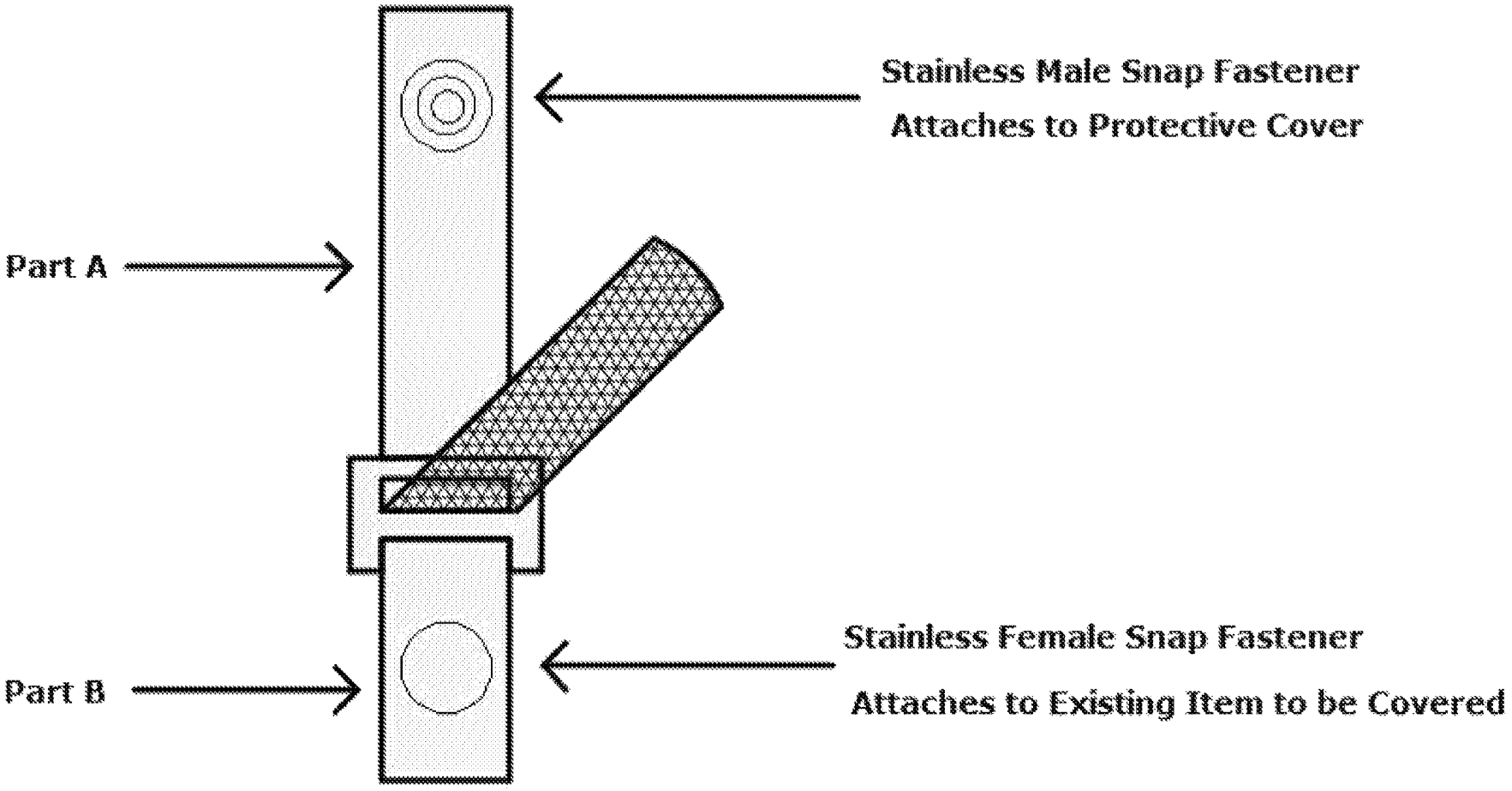

Referring to FIG. 4 is showing item A which is the hook and loop strap with the marine grade stainless male snap looped through the buckle of item B with the marine grade stainless female snap.

Figure 5:
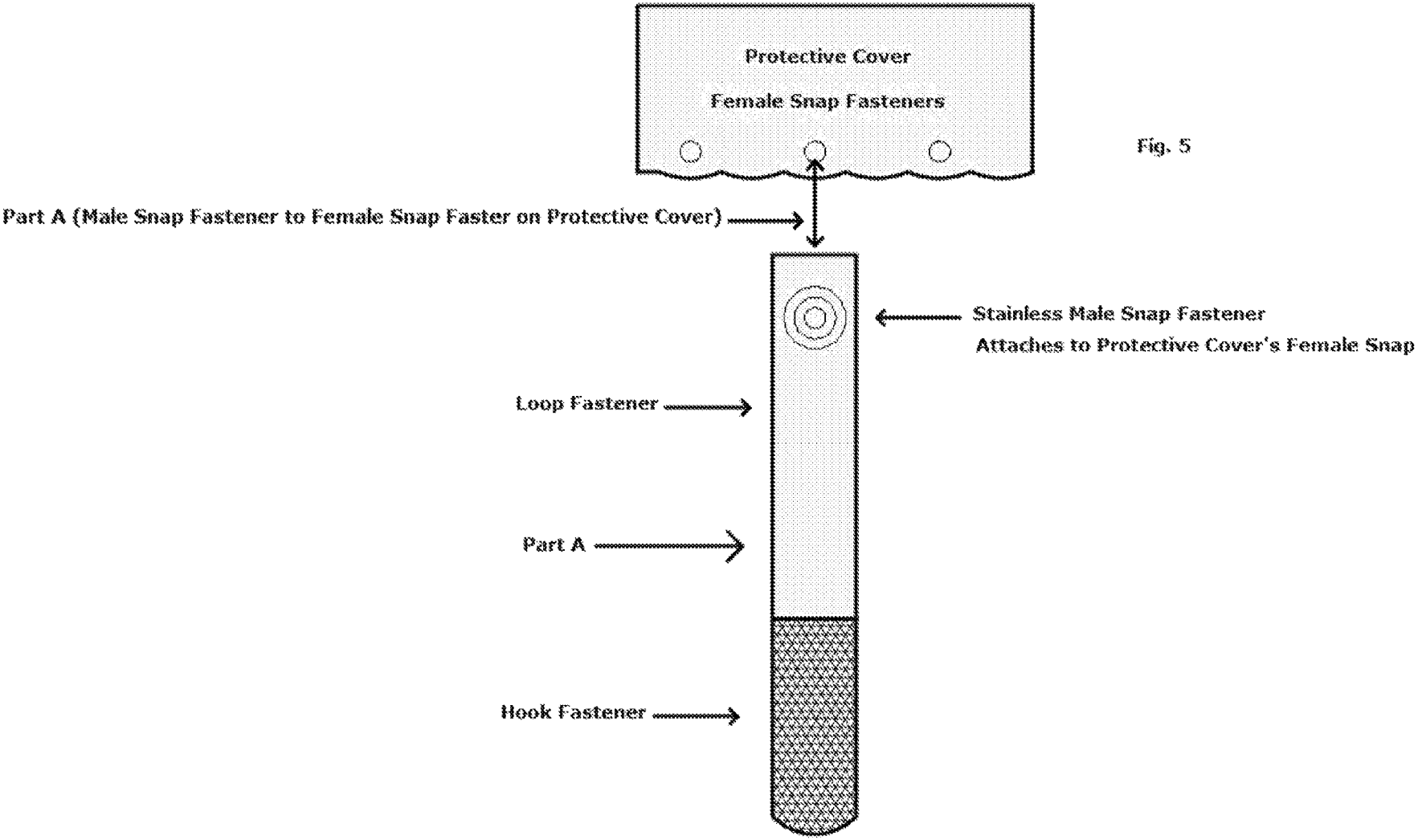

Referring to FIG. 5 is showing an illustration of where item A which is the hook and loop strap with a marine grade stainless male snap will attach to a protective cover using the covers female snap.

Figure 6:
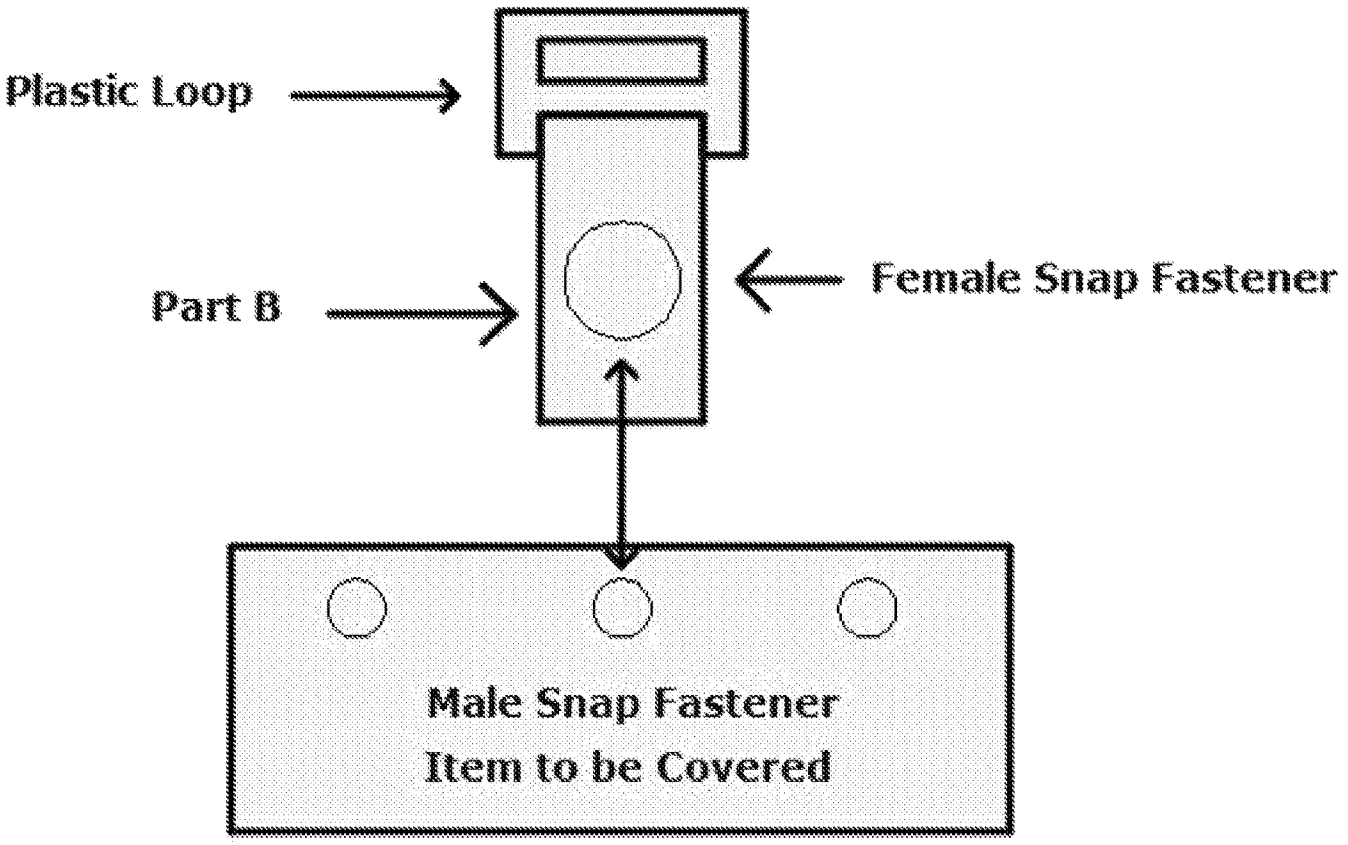

Referring to FIG. 6 is showing an illustration of where B which is the buckle section with a marine grade stainless female snap will attach to the item to be covered using the items male snap.

Figure 7:
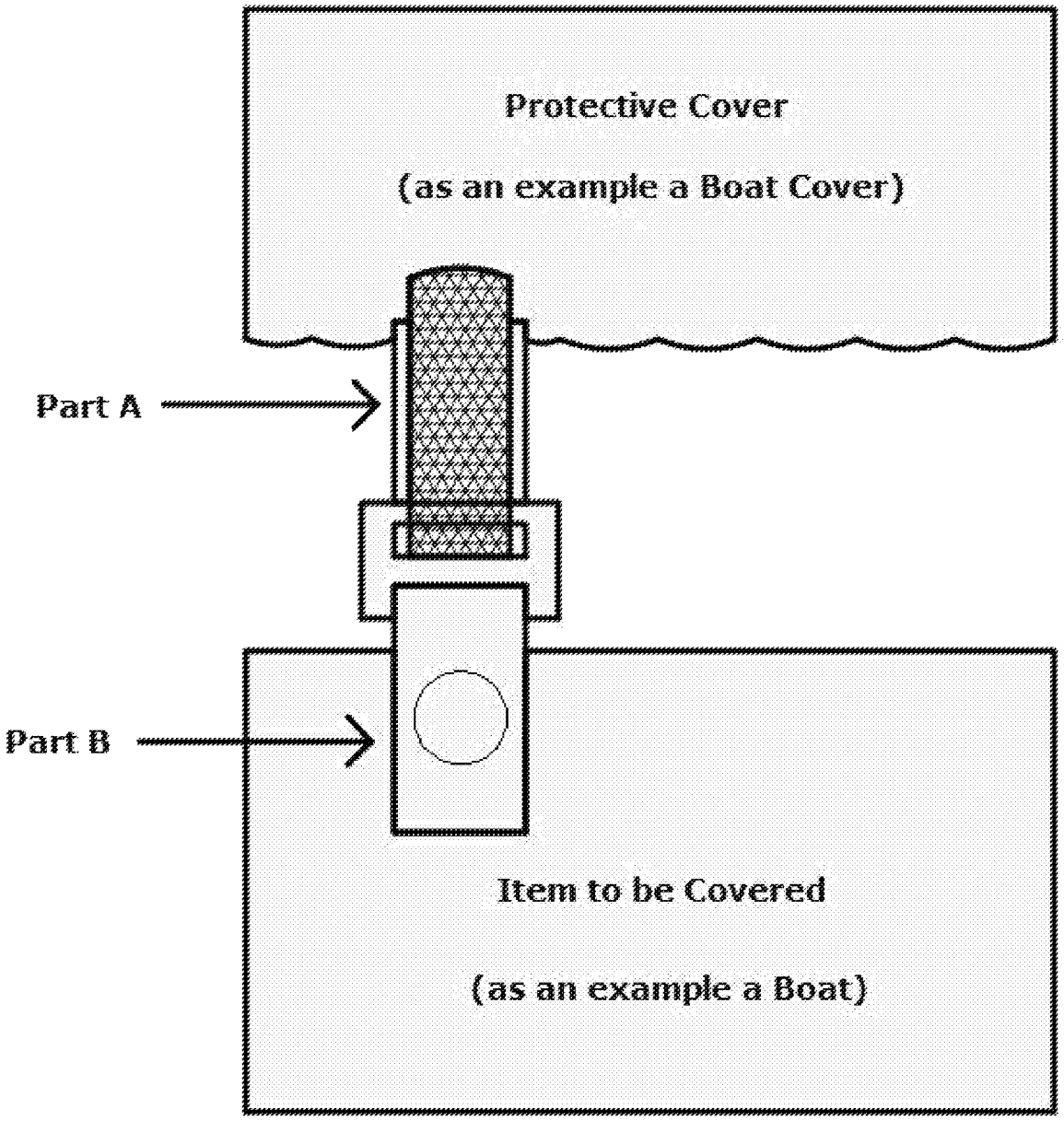

Referring to FIG. 7 is showing an illustration of where item A which is the hook and loop strap with a marine grade stainless male snap is attached to a protective cover using the covers female snap and looped through the buckle of item B which is the buckle section with a marine grade stainless female snap that is attached to the item to be covered using the items male snap. Items A and B have now joined the protective cover to the item to be covered cinched tight and fully installed.

BRIEF DESCRIPTION OF THE INVENTION FOR NEW MANUFACTURING

Figure 8:
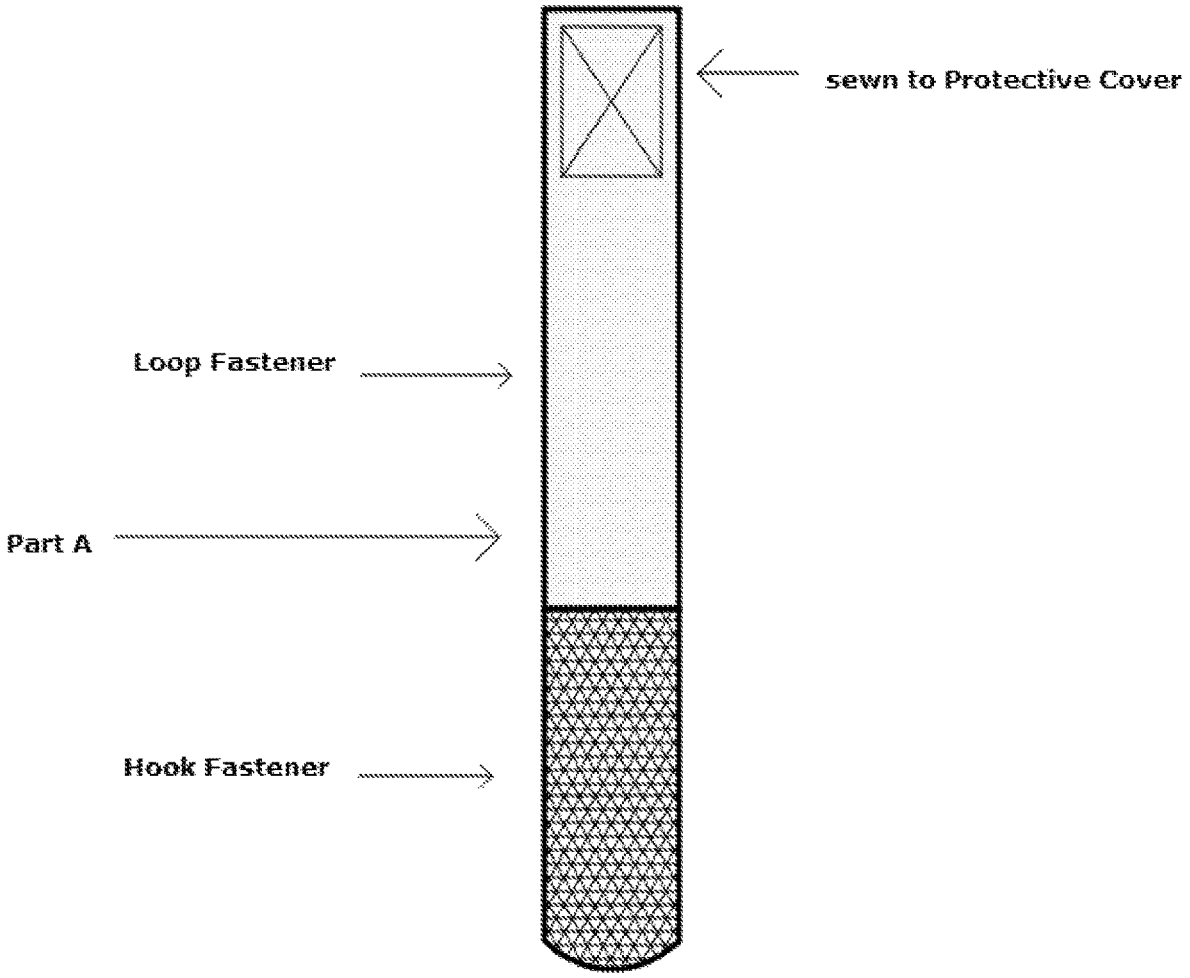
FIGS. 8 through 14 represents the new installation system.

FIG. 8 is an illustration of the method and system of this invention for new manufacturing showing the hook and loop strap for new cover installation referenced as part A.

Figure 9:
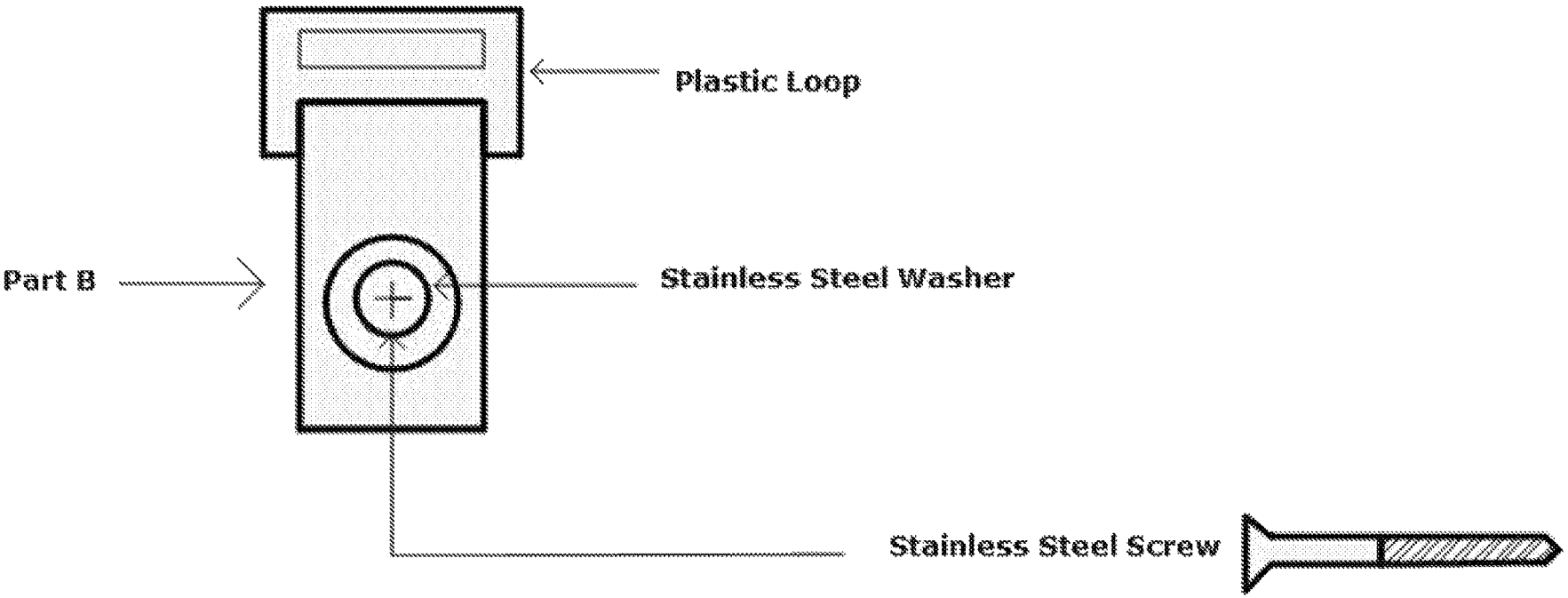

FIG. 9 is an illustration of the method and system of this invention for new manufacturing showing the buckle section with a stainless screw and washer referenced as part B.

Figure 10:
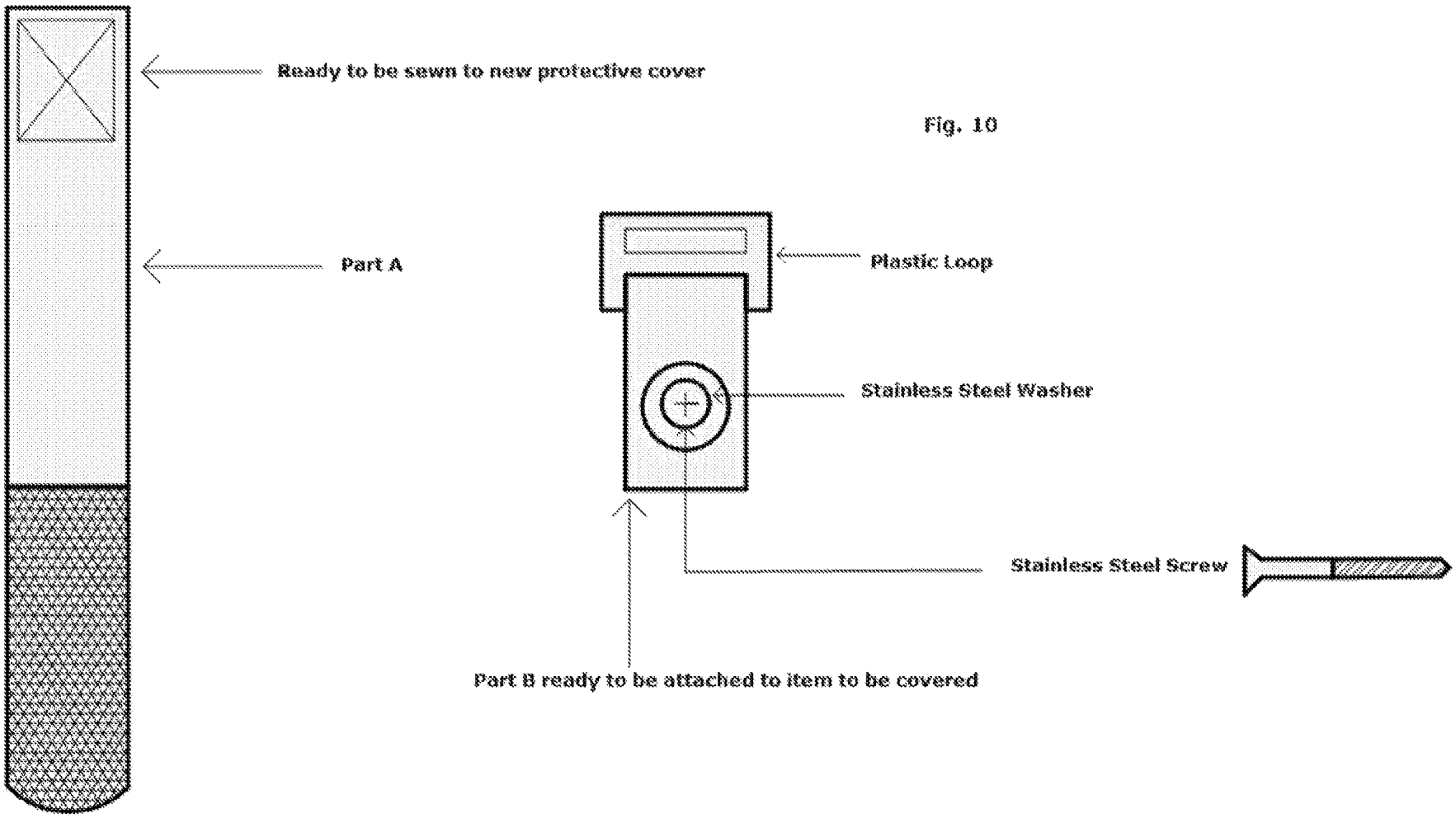

FIG. 10 is an illustration of the method and system of this invention showing the hook and loop strap referenced as part A ready to be sewn onto a new protective cover and the buckle section referenced as part B with a marine grade stainless screw and washer ready to be installed on an item to be covered.

Figure 11:
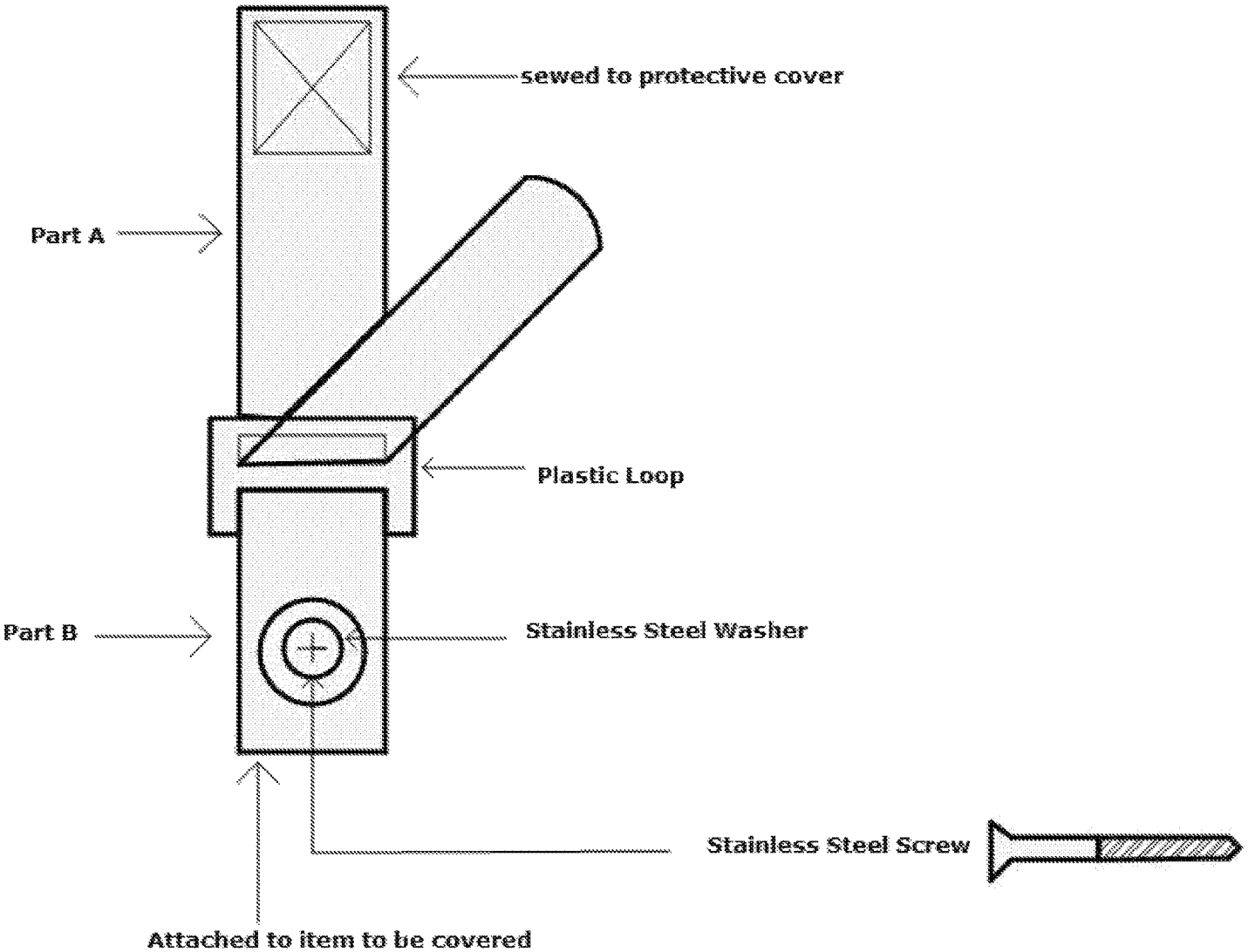
Figure 12:
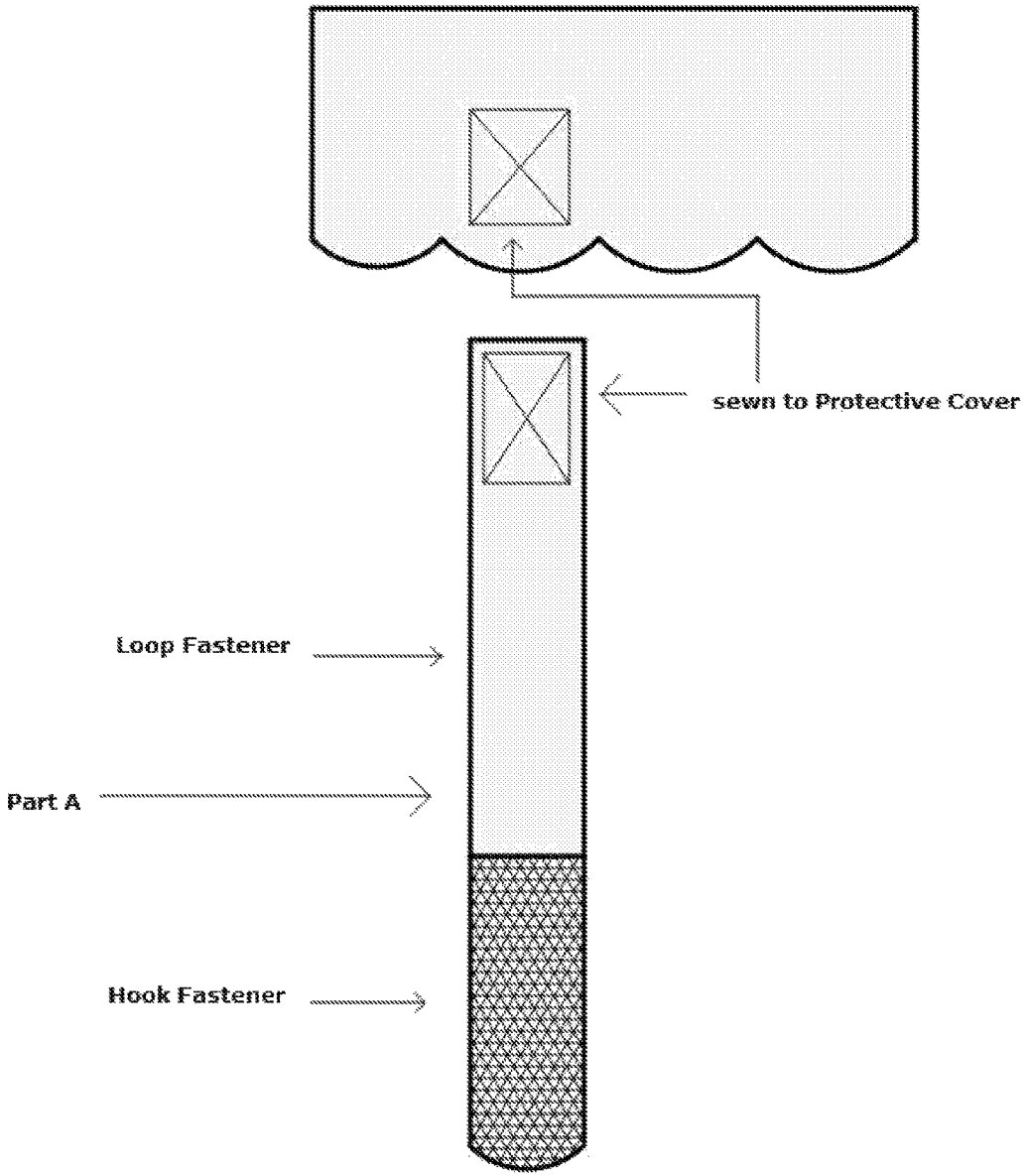

FIG. 11 is an illustration of the method and system of this invention showing the hook and loop strap referenced as part A which is looped through the buckle section referenced as part B FIG. 12 is an illustration of the method and system of this invention showing the hook and loop strap that is referenced as part A showing where it will be sewn to the protective cover.

Figure 13:
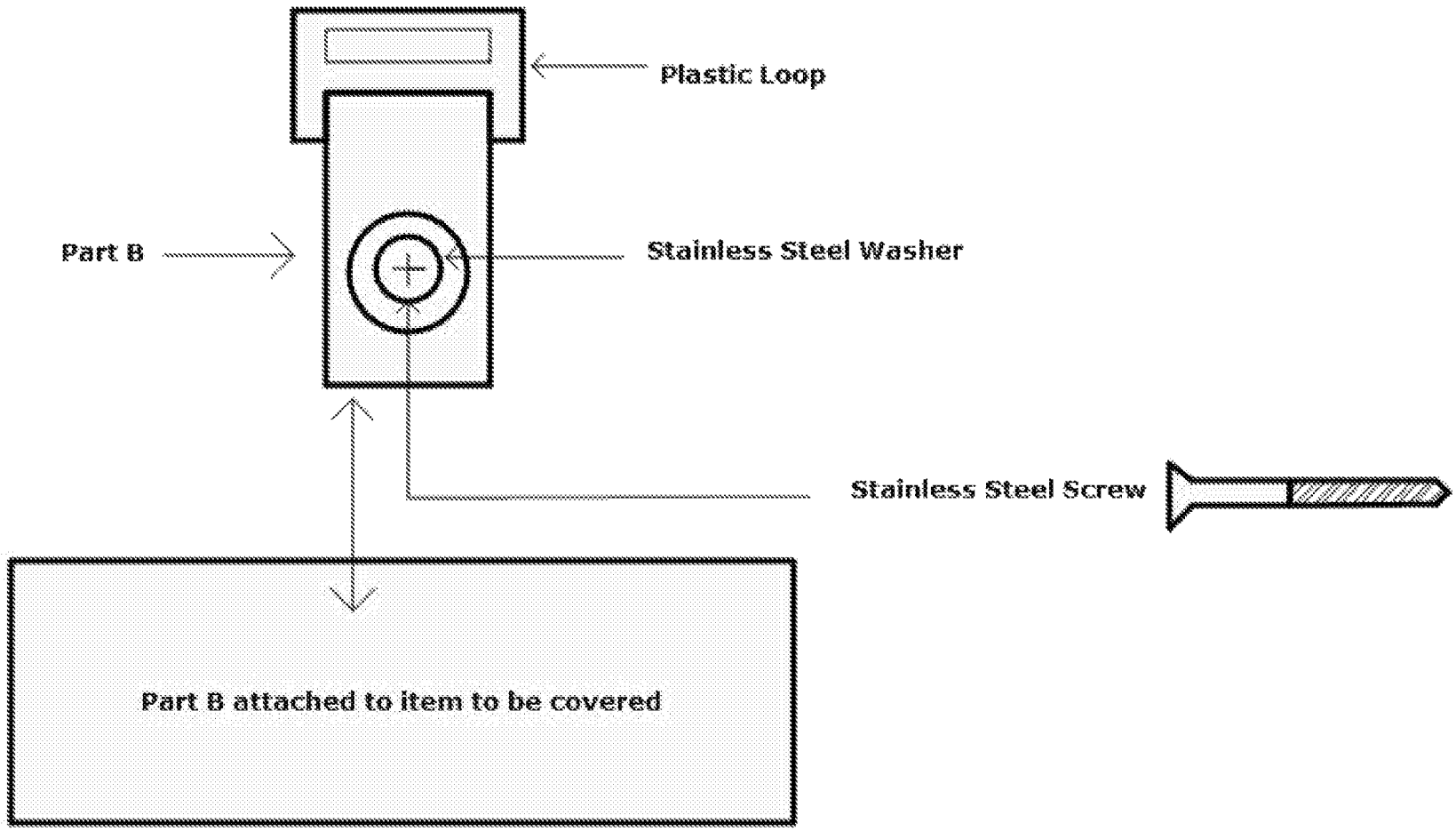

FIG. 13 is an illustration of the method and system of this invention showing the buckle section referenced as part B indicating where is will be attached to the item to be covered with the stainless screw and washer.

Figure 14:
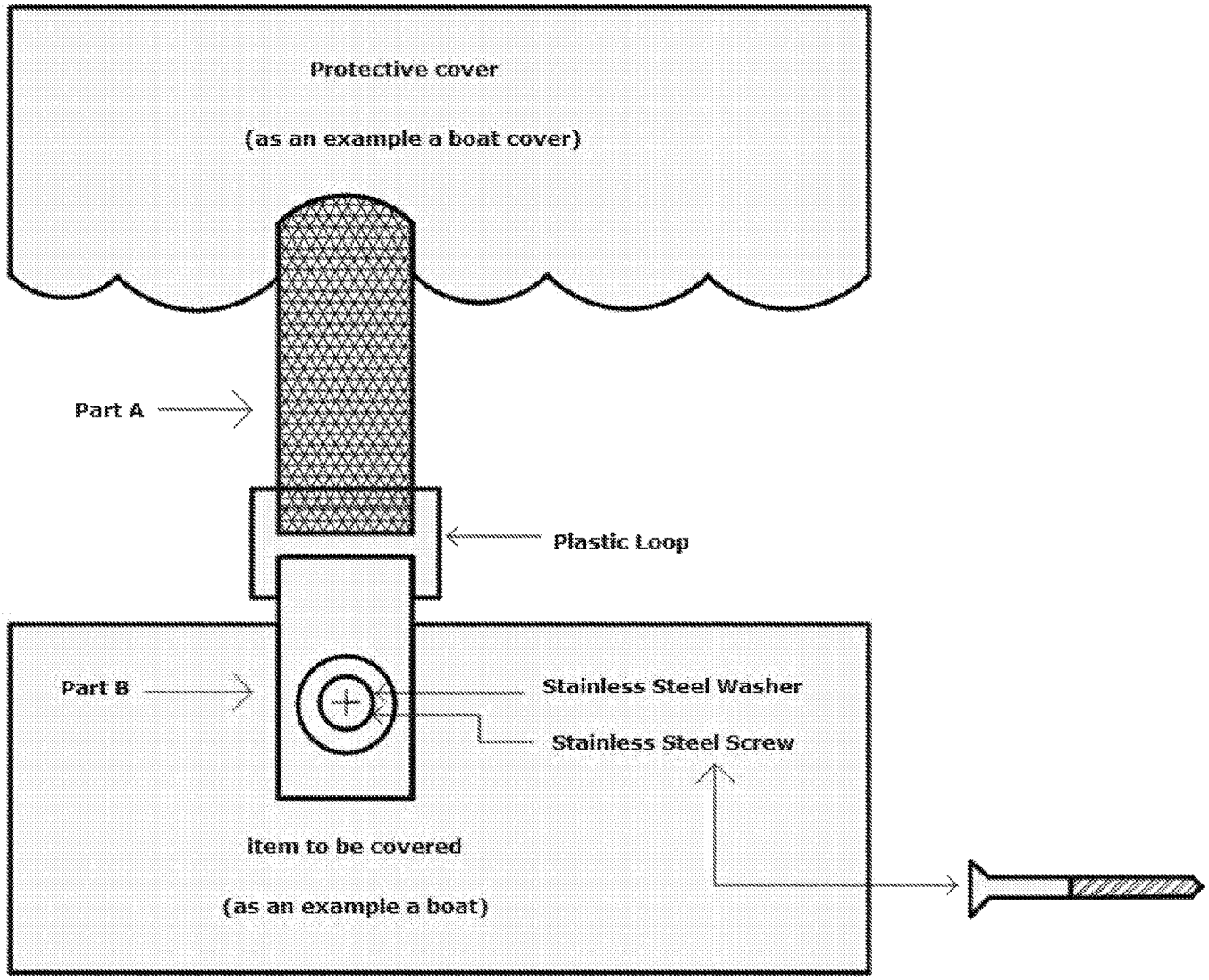

FIG. 14 is an illustration of the method and system of this invention showing the hook and loop strap referenced as part A that is sewn to the protective cover looped through the buckle section referenced as part B attached to the item to be covered.

DETAILED DESCRIPTION OF THE INVENTION FOR NEW MANUFACTURING

Referring to FIG. 8 is showing item A which is the hook and loop strap which is ready to be sewn to a new protective cover.

Referring to FIG. 9 is showing item B which is the buckle section with a stainless screw and washer ready to be attached to an item to be covered.

Referring to FIG. 10 is showing both items A and B which are ready to be attached to the new protective cover and new item to be covered.

Referring to FIG. 11 is showing item A which is the hook and loop strap looped through the buckle of item B.

Referring to FIG. 12 is showing an illustration of where item A which is the hook and loop strap is to be sewn to a protective cover.

Referring to FIG. 13 is showing an illustration of where B which is the buckle section with a stainless screw and washer will attach to the item to be covered.

Referring to FIG. 14 is showing an illustration of where item A which is the hook and loop strap that has been sewn to a protective cover and looped through the buckle of item B which is the buckle section which has been installed with a stainless screw and washer to the item to be covered. Items A and B have now joined the protective cover to the item to be covered and cinched tight and fully installed.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art without departing from the spirit of this invention.

The embodiments of the invention in which an exclusive property or privilege is claimed are defined for retro installation is as follows:

1. A two part adjustable connection system for connecting a female snap positioned on a cover with a male snap positioned on an item to be covered, the two part adjustable connection system consisting of:

a first part in the form a strap, the strap has hook fastener and loop fastener on a first side of the strap and a male snap fastener configured to connect with the female snap positioned on the cover directly attached to a first end of the strap; and a second part having a first end carrying a female snap fastener configured to connect to the male snap positioned on the item to be covered and a second end carrying a buckle; wherein the strap of the first part is configured to extend through the buckle of the second part and the hook fastener is configured to secure to the loop fastener such that the first part is secured to the second part, wherein that the two part adjustable connection system enables easy connection of the cover and the item to be covered even when the cover has shrunk in size due to age and exposure to environmental elements.

2. The two part adjustable connection system of claim 1, wherein the male snap fastener, the female snap fastener and the buckle are made of marine grade stainless.

3. The two part adjustable connection system of claim 1, wherein the first part is configured to remain attached to the cover and the second part is configured to remain attached to the item to be covered when the two part adjustable connection system is not in use.

* * * * *